US005647523A

United States Patent [19]

Richard

[11] Patent Number: 5,647,523

[45] Date of Patent: Jul. 15, 1997

[54] TENNIS BALL BELT

[76] Inventor: Russell Richard, 13355 Northborough #1721, Houston, Tex. 77067

[21] Appl. No.: 534,986

[22] Filed: Sep. 27, 1995

[51] Int. Cl.[6] ..... A45F 3/00

[52] U.S. Cl. ..... 224/684; 224/682; 224/919

[58] Field of Search ..... 224/660, 676, 224/682, 684, 250, 919, 901, 901.2, 901.4; D3/221, 229

[56] References Cited

U.S. PATENT DOCUMENTS

| | | | |
|---|---|---|---|
| D. 277,810 | 3/1985 | Pickens | D3/229 |
| D. 282,694 | 2/1986 | Gault | D3/229 |
| D. 290,306 | 6/1987 | Pickens | D3/229 |
| 4,079,871 | 3/1978 | Sica | 224/919 |
| 4,396,136 | 8/1983 | Stafford et al. | 224/919 |
| 4,416,404 | 11/1983 | Daniels | 224/676 |
| 4,433,803 | 2/1984 | Liberboim | 224/919 |
| 4,706,860 | 11/1987 | Leider | 224/919 |
| 4,836,427 | 6/1989 | McManus | 224/901 |
| 5,259,541 | 11/1993 | Reese | 224/919 |

FOREIGN PATENT DOCUMENTS

| | | | |
|---|---|---|---|
| 2813432 | 10/1979 | Germany | 224/919 |

*Primary Examiner*—Henry J. Recla
*Assistant Examiner*—Gregory M. Vidovich

[57] ABSTRACT

A belt for carrying tennis balls and the like for wearing around the waist of its user. The belt comprises of six pockets for which tennis balls are carried. Hook and loop fasteners at each end of the belt serve as means to connect the two ends of the belt. The ball belt can be adjusted to fit a small or large waist by adjusting the position of the hook and loop fasteners.

4 Claims, 4 Drawing Sheets

TENNIS BALL BELT

BACKGROUND—FIELD OF INVENTION

This invention relates to belts, especially to a ball belt for use of carrying balls to facilitate easy handling, the belt may also be worn.

In sports, especially of the game tennis there is a need for a belt that can hold tennis balls. This belt can be used with very minimum of effort and time and then serve a dual purpose of being worn and holding tennis balls until ready for use.

It has been found most desirable if such a belt could be worn while holding tennis balls providing more convenience to the user. It has also been found most desirable if the belt would hold tennis balls for transport from one place to another.

Therefore, the present invention is a belt which has the combined attributes of lightweight, easy to use, able to be carried in one hand or worn around the user's waist while the user engages in the game of tennis.

PRIOR ART

Carrying and transporting tennis balls in ones hands is a common nuance for many tennis players. In the past many tennis players have chosen to stuff tennis balls in their tennis shorts pockets and to strap tennis balls under the elastic strap of their shorts and some have often reluctantly carried balls in their hands.

No belt is known, however, for carrying tennis balls with option of being worn around the user's waist.

SUMMARY OF INVENTION

The present invention is directed to a belt having parallel pockets whereby the pockets are sewn onto the inner face of the belt to support the ball belt pockets while holding tennis balls.

The present invention is also directed to the belt having a hook and loop fasteners on each end of the belt for attaching the two ends.

OBJECTS AND ADVANTAGES

Accordingly, I claim the following as my objects and advantages of the invention: to provide a belt for easy, reliable, and conveniently carrying of tennis balls, to provide a belt that may be carried in one hand or worn around the waist of its user, to provide a belt which requires a minimum of skill to use, and to provide a belt which will prolong tennis players playing time as opposed to chasing balls.

In addition I claim the following additional objects and advantages: to provide a belt that holds up to six tennis balls, to provide a tennis player with the convenience of having his tennis balls readily available for use without the need of pulling balls out of tennis short pockets, and to provide a very fashionable belt that does not hinder the user's movement while playing tennis.

DRAWING REFERENCE NUMERALS

1—nylon belt
2—left edge of 1
3—right edge of 1
4—ball pocket
5—ball pocket
6—ball pocket
7—ball pocket
8—ball pocket
9—ball pocket
10—top left leg of 4
11—top right leg of 4
12—top left leg of 5
13—top right leg of 5
14—top left leg of 6
15—top right leg of 6
16—top left leg of 7
17—top right leg of 7
18—top left leg of 8
19—top right leg of 8
20—top left leg of 9
21—top right leg of 9
22—bottom left leg of 4
23—bottom right leg of 4
24—bottom left leg of 5
25—bottom right leg of 5
26—bottom left leg of 6
27—bottom right leg of 6
28—bottom left leg of 7
29—bottom right leg of 7
30—bottom left leg of 8
31—bottom right leg of 8
32—bottom left leg of 9
33—bottom right leg of 9
34 left hook and loop fastener
35—left edge of left hook and loop fastener
36—right edge of left hook and loop fastener
37—right hook and loop fastener
38—left edge of right hook and loop fastener
39—right edge of right hook and loop fastener
40—180 degree fold on 1
41—top edge of 1
42—bottom edge of 1
43—bottom edge of 34
44—top edge of 34
45—top edge of 37

46—bottom edge of 37
47—stitch along 180 degree fold on 1

DESCRIPTION OF THE PREFERRED EMBODIMENT

Figure 1:
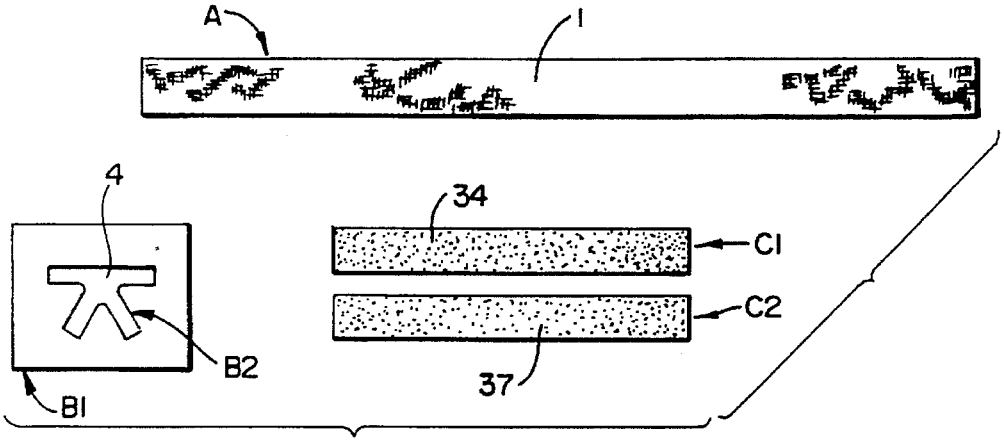
FIG. 1 shows the material necessary to embody a tennis ball belt: A—68 inches of 2 inch wide nylon webbing, B1—spandex material, B2—pattern that must be cut from B1 for tennis ball belt pockets, C1—21 inches of 2 inch wide hook and loop fastener, C2—companion hook and loop fastener of C1.

FIG.1 shows the material necessary to form the tennis ball belt. Reference character 1 is representative of 68 inches of 2 inch wide nylon webbing which serves as the base of the ball belt. The figure shows is representative of the spandex material from which the ball belt pockets are cut. FIG. 1 shows the pattern for one of the ball belt pockets, identified as reference character 4, as it is cut from a piece of material. Reference character 34 is representative of the 21 inch long, 2 inch wide industrial strength hook and loop fastener cushion serving as the ball belt adjustable fastener. Reference character 37 is representative of a 21 inch long, 2 inch wide industrial strength companion hook and loop adjustable fastener of reference character 34.

Figure 2:
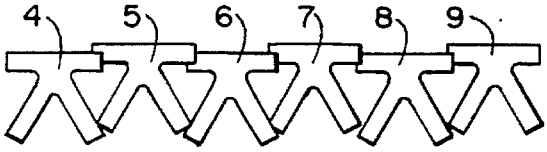
FIG. 2 shows ball belt pockets laid horizontally ready for attachment.
Figure 2A:
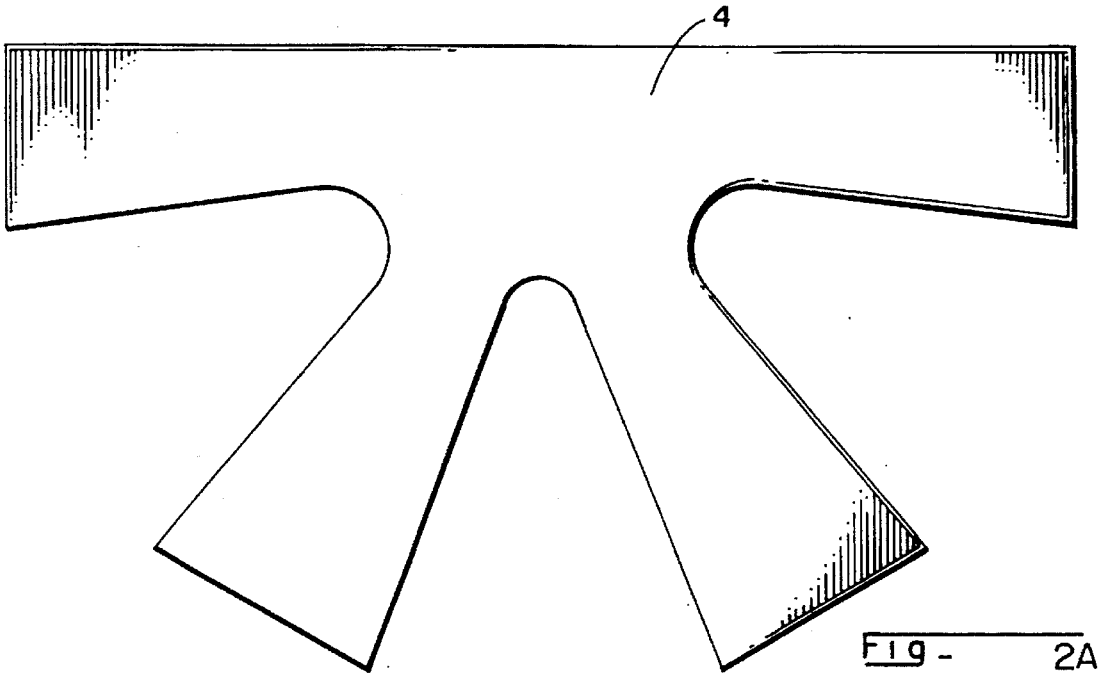
FIG. 2A shows a ball belt pocket pattern.

FIG. 2 is representative of six spandex ball belt pockets cut from the material and laid horizontally to each other for attachment to the belt. FIG. 2A is a detailed view of a single ball belt pocket.

Figure 3:
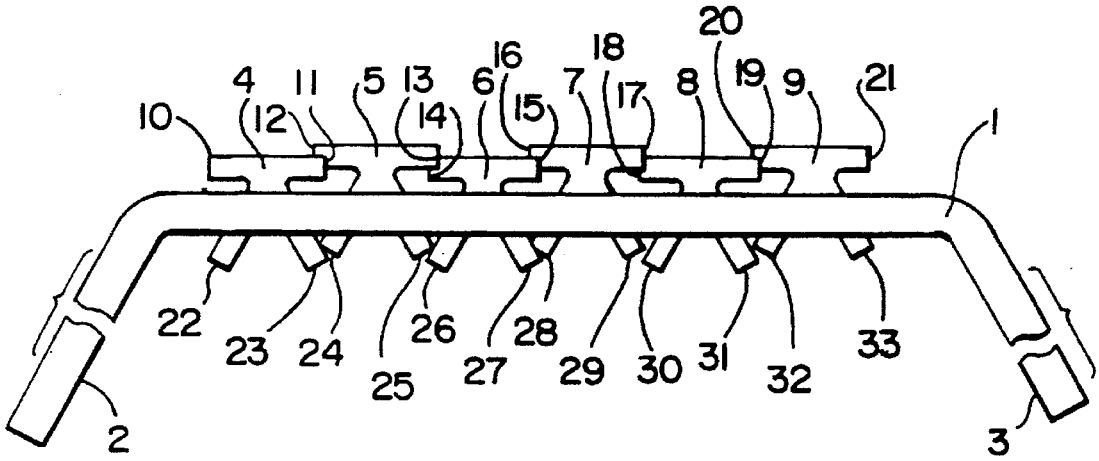
FIG.3 shows the nylon webbing laid across the cut ball belt pockets ready for attachment.

FIG.3 illustrates 1 laid across 4, 5, 6, 7, 8, 9.

Figure 4:
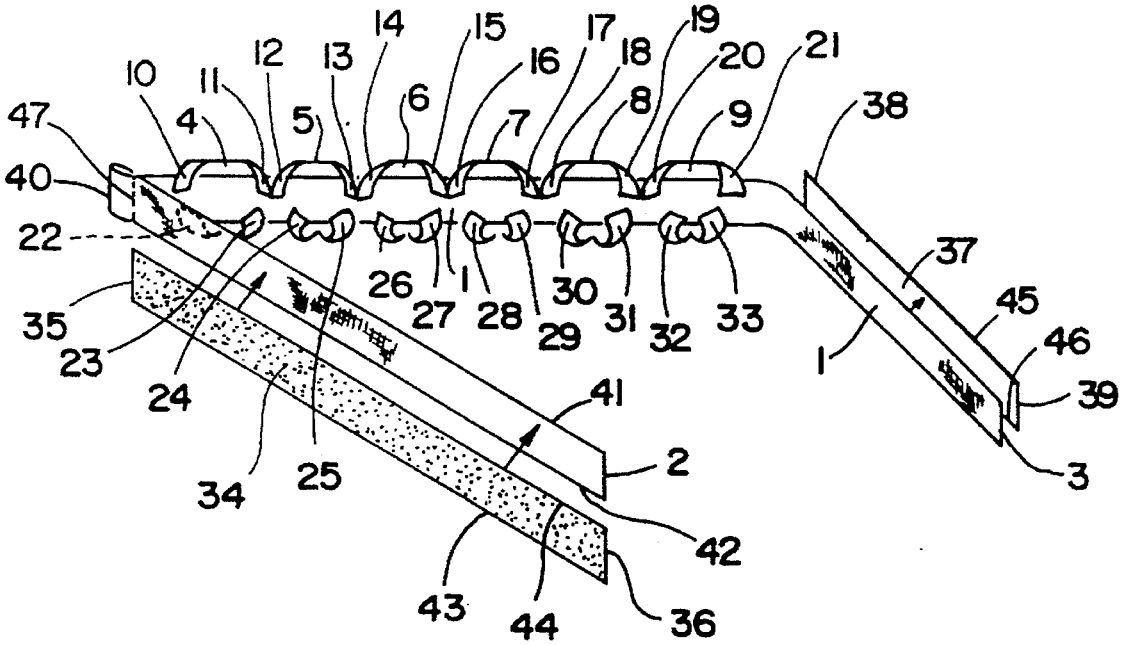
FIG.4 shows the ball belt pocket being attached to the nylon webbing, it also shows the hook and loop fasteners ready for attachment at each end of the nylon webbing, and it shows a 180 degree fold at the left end of the ball belt.

FIG.4 illustrates the attachment of 4, 5, 6, 7, 8, 9 to 1. FIG.4 further illustrates 10, 11, 12, 13, 14, 15, 16, 17, 19, 20, 21, 22, 23, 24, 25, 26, 27, 28, 29, 30, 31, 32, 33 being attached to the inner side of 1. FIG.4 further illustrates the attachment of 34 to the left end of 1 so that 2 and 36 are parallel and aligned when the belt is assembled such that the edges 2 and 36 form a single edge for the assembled belt. FIG.4 further illustrates the attachment of 37 to the right end of 1 so that 3 and 39 are aligned when the belt is assembled such that the edges 3 and 39 form a single edge for the assembled.

NOTE: 34 and 37 should be firmly sewn onto 1 along the entire length of the borders of 35, 36, 43, 44, 38, 39, 45, 46.

Figure 5:
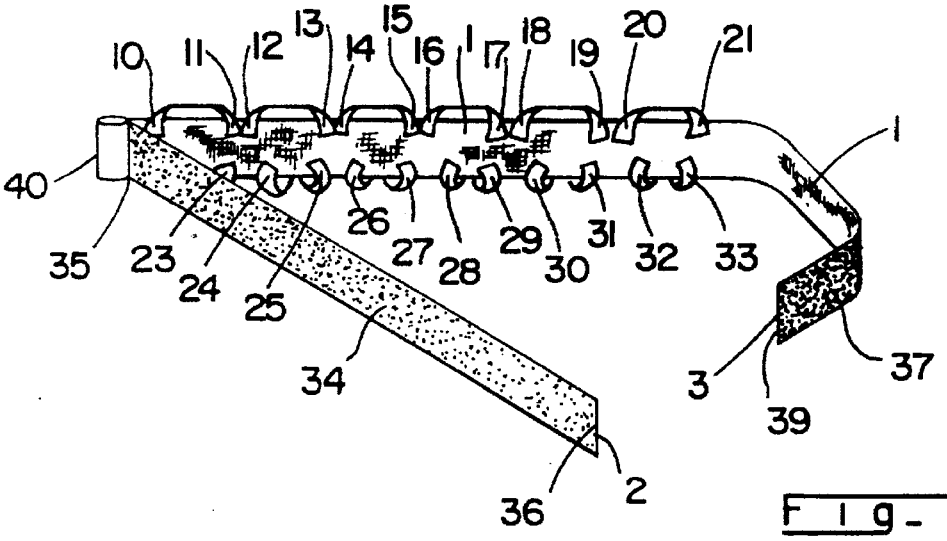
FIG.5 shows the attached ball belt pockets and the attached hook and loop fasteners sewn onto the nylon webbing.

FIG.5 illustrates the embodiment described in FIG.4 and shows the belt folded 180 degrees so that the portion of the belt having the left velcro fastener 34 folds into abutment with the portion of the belt containing the ball pockets across 10, 11, 12, 13, 14, 15, 16, 17, 18, 19, 20, 21, 22, 23, 24, 25, 26, 27, 28, 29, 30, 31, 32, 33 and 2 now rest on the inner face of 1.

Figure 6:
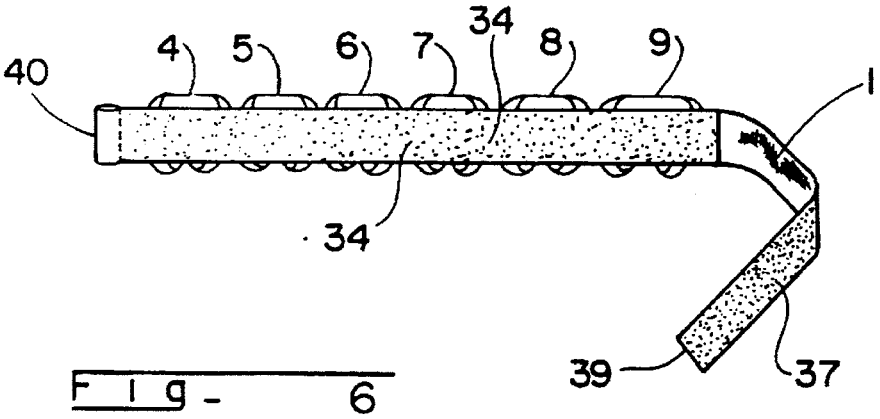
FIG.6 shows the folded portion of the webbing(attached to the hook and loop) being sewn on the top of the legs of the ball belt pockets and attached to the inner side of the nylon webbing, it also shows a rear perspective view of the tennis ball belt.

FIG. 6 shows the tennis ball belt in its assembled and completed form. NOTE: 34 should be securely sewn across 10, 11, 12, 13, 14, 15, 16, 17, 18, 19, 20, 21, 22, 23, 24, 25, 26, 27, 28, 29, 30, 31, 32, 33 thus adding additional stability for the ball belt pockets 4, 5, 6, 7, 8, 9 and also providing firm connection for 34 onto 1's inner face.

Figure 7:
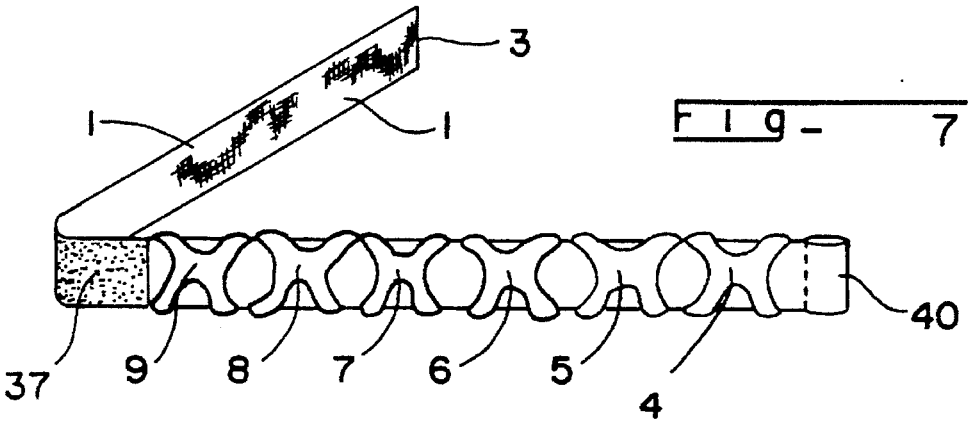
FIG.7 shows a front perspective view of the tennis ball belt.

FIG.7 is representative of a front perspective view of a completely embodied tennis ball belt.

Figure 8:
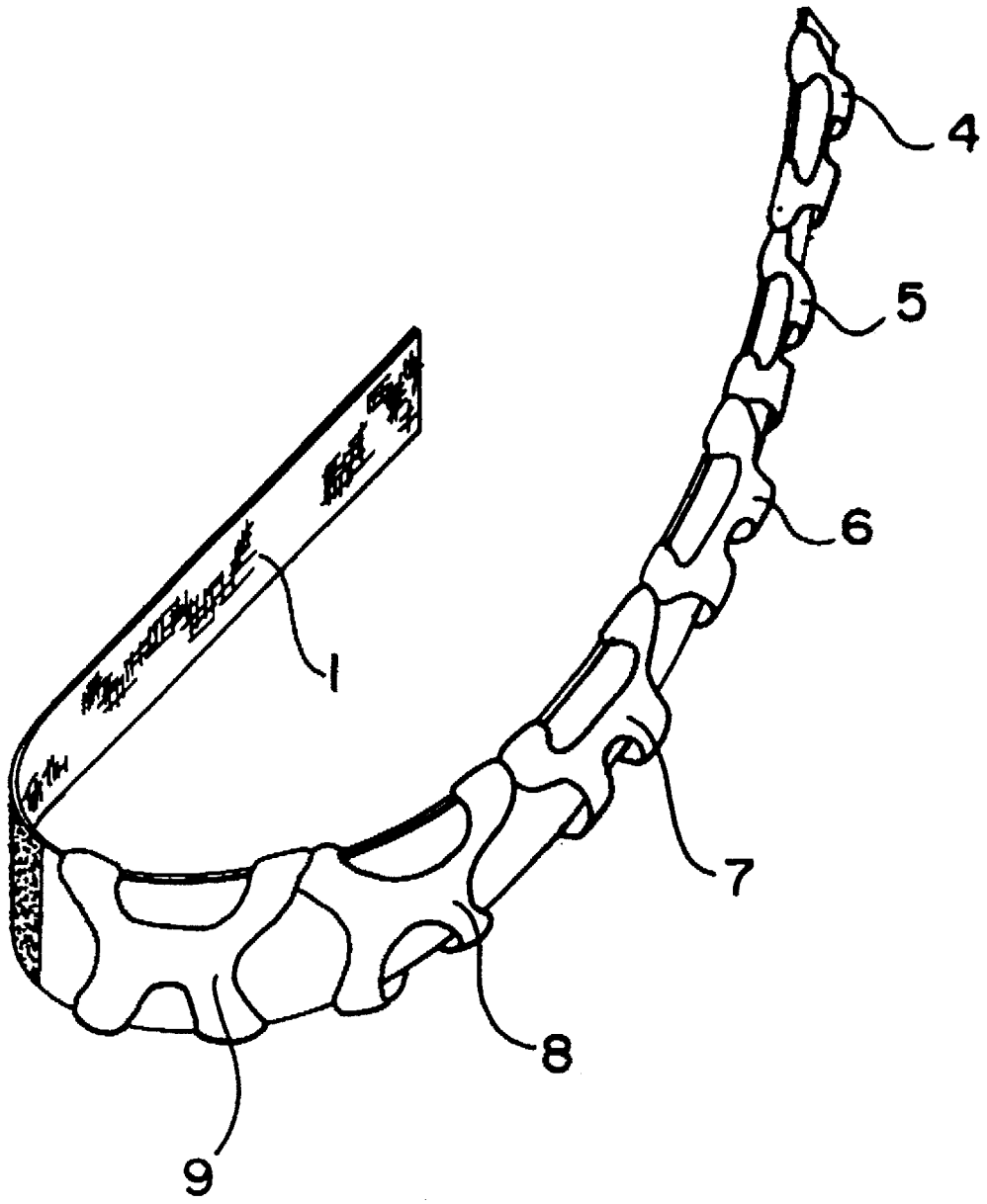
FIG.8 shows a 3 dimensional front, top and side view of the tennis ball belt.

FIG.8 is a three dimensional, front, top, side perspective view of the tennis ball belt.

The above description of the figures explains the basic attachment of the components to one another as well as their assembly. The following narrative description further clarifies the construction and use of the tennis ball belt.

In general, the tennis ball belt is made of an elongated strip of flexible material, a plurality of pocket members on the strip of material, and an adjustable fastener that can selectively attach the opposing ends of the strip of material. The elongated strip of flexible material, or nylon belt 1, has an inner surface, an outer surface, opposing ends, 2 and 3, a top edge 41, and a bottom edge 42. The strip is relatively thin and narrow, similar to a belt.

Each of the plurality of pocket members is formed of a resilient material and has an upper support band and at least one lower support band. The pocket members fixedly attach to the strip and extend from the outer surface of the strip. The upper support band has opposing ends that attach to the strip at or near the upper edge of the strip. The ends of the band are attached to the strip relatively close to one another so that upper support band forms a loop extending from the outer surface of the strip. In this way the loop formed by the upper support band and the strip define an opening to the pocket member. The circumference of the opening is slightly smaller than the greatest circumference of a tennis ball. However, because the pocket member (and the upper support band) are formed of a resilient material, the opening will expand to receive a tennis ball therethrough and then return to its original size. Thus, a tennis ball placed within the pocket member cannot escape unless a force is applied to the ball.

Preferably, each pocket member has two lower support bands. The lower support bands extend between and connect to the upper support band at a position intermediate the upper support band ends and the bottom edge of the strip. With this arrangement of the support bands, a tennis ball placed within the pocket member is supported by the strip on its back side, the side of the tennis ball nearest the strip. Also, the tennis ball is supported on its front side, the side furthest from the strip, by the bands. In addition, the tennis ball is supported from the bottom, the side opposite the opening, by the lower support strip and its sides by the upper support band and the lower support band. As described previously, the resiliency of the upper support band prevents the tennis ball from exiting the pocket member through the opening. Therefore, the tennis ball is supported from the top by the upper support band. The resiliency of the pocket member forces the tennis ball against the strip and limits the motion of the tennis ball within the pocket member.

The upper support band and the lower support bands are preferably relatively narrow and define access openings between the bands. These access openings are sufficiently large that a user can push against a lower portion of the tennis ball held within the pocket member and can force the tennis ball out through the opening. In this way, the user may easily remove the tennis ball from the pocket member without having to expand and reach through the opening.

Specifically, the preferred attachment is as follows. The pocket members are positioned intermediate the ends of the band adjacent one another. The ends of the upper support band extend over the top edge of the strip and abut the inner surface of the strip. Likewise, the ends of the lower support bands extend under the bottom edge of the strip and abut the inner surface of the strip. The strip is then folded so that the strip envelops all of the upper support band ends and lower support band ends that abut the inner surface of the strip, the lower connecting ends between the butting inner surface of the strip. When the fold is made, the top edge and the bottom edge of the intermediate portion of the strip from which the pocket members extend and the top edge and the bottom edge of the folded portion of the strip are aligned respectively. In other words the fold is a 180 degree fold. Consequently, the strip protects the attachment ends of the pocket members between its folded layers. After the fold is made, the adjacent edges of the of the abutting portions of the strip are fixedly connected to one another. Thereby, the connected edges fixedly secure the connecting ends of the pocket members therebetween. Because the strip has a smooth outer surface and folds to envelope the connecting ends of the pocket members, the surface of the tennis ball belt that contacts the user when wearing the belt is smooth.

The cooperating ball belt adjustable fastener provides for selective and adjustable attachment of the opposing ends of the strip. Although a number of known fasteners may be used, the preferred fastener is a hook and loop fastener. The hook and loop fasteners not only allow selective attachment of the ends of the strip, but also facilitates adjustment of the size of the belt to accommodate varying waist sizes. To allow for a greater range of adjustment, the hook and loop fasteners should extend along a substantial length of the belt. Also, the strip has a length that allows use of the belt by users no matter what their waist size.

With this design for the tennis ball belt, a user can easily carry a number of tennis balls while playing tennis, has easy and quick access to the tennis balls, and can play tennis without being concerned that the tennis balls will escape from the tennis ball belt. Accordingly, the user can increase their playing time and lessen the inconvenience associated with handling tennis balls.

I claim:

1. A tennis ball belt comprising:

an elongated strip of flexible material having an inner surface, an outer surface, opposing first and second ends and an intermediate portion therebetween, a top edge, and a bottom edge;

a plurality of pocket members each formed from a resilient, expandable material, each of the pocket members having an upper support band and at least one lower support band, the upper support band having opposite ends, the at least one lower support band connected between the opposite ends of the upper support band and extending downwardly therefrom to a lower support band end;

each pocket member being positioned adjacent the outer surface of the intermediate portion of the strip, the opposite ends of the upper support band extending over the top edge of the strip and abutting the inner surface of the strip, the lower support band end extending under the bottom edge of the strip and abutting the inner surface of the strip wherein the first end of the strip is folded about a fold section such that the inner surface of the first end of the strip overlies the ends of the upper support band and the end of the lower support band and abuts the inner surface of the intermediate portion of the strip, and means for securing the inner surface of the first end to the inner surface of the intermediate portion along the top and bottom edges thereof, thereby securing each of the pocket members to the strip such that an upper opening is formed between the outer surface of the strip and the upper support band of each pocket member, whereby a tennis ball is adapted to be received by the upper opening and supported by the pocket member; and cooperating fasteners connected on the outer surface of each of the first and second ends of the strip.

2. The tennis ball belt of claim 1 wherein access openings are defined between the upper support band and the at least one lower support band whereby a user may push against a tennis ball supported by one of the pocket members and force the tennis ball through the upper opening.

3. The tennis ball belt of claim 1 wherein the cooperating fasteners are hook and loop fasteners.

4. The tennis ball belt of claim 1 wherein the strip is formed of nylon webbing.

* * * * *